US006990954B2

(12) United States Patent
Hochstrasser et al.

(10) Patent No.: US 6,990,954 B2
(45) Date of Patent: Jan. 31, 2006

(54) METHOD, DEVICE AND COMPUTER PROGRAM FOR CONTROLLING AN INTERNAL COMBUSTION ENGINE

(75) Inventors: Patrick Hochstrasser, Tamm (DE); Christina Sauer, Benningen (DE); Gholamabas Esteghlal, Ludwigsburg (DE); Juergen Schiemann, Markgroeningen (DE); Georg Mallebrein, Korntal-Muenchingen (DE); Eberhard Klein, Plochingen (DE)

(73) Assignee: Robert Bosch GmbH, Stuttgart (DE)

( * ) Notice: Subject to any disclaimer, the term of this patent is extended or adjusted under 35 U.S.C. 154(b) by 46 days.

(21) Appl. No.: 10/491,908

(22) PCT Filed: Jul. 20, 2002

(86) PCT No.: PCT/DE02/02685

§ 371 (c)(1),
(2), (4) Date: Apr. 8, 2004

(87) PCT Pub. No.: WO03/033891

PCT Pub. Date: Apr. 24, 2003

(65) Prior Publication Data

US 2004/0194758 A1 Oct. 7, 2004

(30) Foreign Application Priority Data

Oct. 8, 2001 (DE) ..... 101 49 475

(51) Int. Cl.
*F02P 5/00* (2006.01)

(52) U.S. Cl. ..... 123/406.12; 123/406.58; 701/102

(58) Field of Classification Search ..... 123/406.12, 123/406.2, 406.23, 406.26, 406.41, 406.42, 123/406.43, 406.58, 406.59; 701/102
See application file for complete search history.

(56) References Cited

U.S. PATENT DOCUMENTS

| | | | | |
|---|---|---|---|---|
| 4,598,680 | A * | 7/1986 | Lanfer | 123/406.23 |
| 5,558,178 | A | 9/1996 | Hess et al. | |
| 5,657,230 | A * | 8/1997 | Hess et al. | 701/104 |
| 5,692,471 | A | 12/1997 | Zhang | |
| 5,832,897 | A | 11/1998 | Zhang | |
| 6,209,519 | B1 * | 4/2001 | Melchior et al. | 123/406.24 |
| 2005/0115542 | A1 * | 6/2005 | Hochstrasser et al. | 123/406.23 |

FOREIGN PATENT DOCUMENTS

| | | |
|---|---|---|
| DE | 43 18 504 | 10/1994 |
| DE | 198 49 329 | 4/2000 |

* cited by examiner

*Primary Examiner*—John T. Kwon
(74) *Attorney, Agent, or Firm*—Walter Ottesen

(57) ABSTRACT

A method and an arrangement as well as a computer program for controlling an internal combustion engine are suggested. A torque model is utilized in the context of the computation of actual quantities and/or actuating quantities. In the context-of the torque model computation, the combustion center is considered which describes the angle at which a specific portion of the combustion energy is converted.

9 Claims, 3 Drawing Sheets

METHOD, DEVICE AND COMPUTER PROGRAM FOR CONTROLLING AN INTERNAL COMBUSTION ENGINE

RELATED APPLICATIONS

This application is the national stage of PCT/DE02/02685, filed Jul. 20, 2002, designating the United States and claiming priority from German patent application No. 101 49 475.0, filed Oct. 8, 2001, the entiure contents of which are incorporated herein by reference.

FIELD OF THE INVENTION

The invention relates to a method and an arrangement as well as a computer program for controlling a combustion engine.

BACKGROUND OF THE INVENTION

For controlling a combustion engine, it is known from DE 42 39 711 A1 (U.S. Pat. No. 5,558,178) to convert a desired value for a torque of the combustion engine into an actuating quantity for influencing the air supply to the combustion engine, for adjusting the ignition angle and/or for suppressing or switching in the fuel supply to individual cylinders of the combustion engine. Furthermore, it is additionally known from WO-A 95/24550 (U.S. Pat. No. 5,692,471) to influence the air/fuel ratio for realizing the pregiven torque value. Furthermore, in the known solutions, the actual torque of the internal combustion engine is computed while considering the instantaneous engine adjustment (charge, fuel metering and ignition angle). Here, the engine rpm, load (air mass, pressure, et cetera) and, if needed, the exhaust-gas composition are applied.

In the context of these computations, a torque model for the combustion engine is used which is used for determining the actuating quantities as well as for determining the actual quantities. The essence of this model is that an optimal torque of the combustion engine and an optimal ignition angle are determined in dependence upon an operating point. The optimal torque and optimal ignition angle are corrected by means of efficiency values in correspondence to the instantaneous adjustment of the combustion engine.

To optimize this model, it is provided in DE 195 45 221 A1 (U.S. Pat. No. 5,832,897) to correct the value for the optimal ignition angle in dependence upon quantities, which influence the degree of efficiency of the internal combustion engine. These quantities include the exhaust-gas recirculation rate, engine temperature, intake manifold air temperature, valve overlap angle, et cetera.

In practice, it has, however, been shown that this known solution can still be optimized, especially with respect to the simplicity of the application, the optimization of the computation time and/or the consideration of the operating-point dependency of the correction of the optimal ignition angle, especially, in dependence upon the inert gas rate. The known torque model shows unsatisfactory results in some operating states. Operating states of this kind are especially states having high inert gas rates in the combustion chamber, that is, states with a high component of inert gas (because of external or internal exhaust-gas recirculation), which are caused by overlapment of inlet and outlet valve opening times and which, above all, occur for low to medium fresh gas charges. Furthermore, these are operating states having a high charge movement. The computed base quantities lead to the situation that a precise torque computation is not achieved with the known procedure because these effects are not adequately considered.

SUMMARY OF THE INVENTION

By considering, in the context of the model computations, the position of the combustion center, that is, the position of the crankshaft angle, at which a specific part (for example, half) of the combustion energy is converted, the following is achieved: the precision of the engine torque, which is computed with the model, is improved for high inert gas rates and low charges; the applicability is simplified; and, the torque model is adapted to engines having lean combustion or engines having a charge movement flap or engines having controllable inlet and outlet valves.

BRIEF DESCRIPTION OF THE DRAWINGS

The invention will be explained in greater detail hereinafter with reference to the embodiments shown in the drawing.

DESCRIPTION OF THE PREFERRED EMBODIMENTS OF THE INVENTION

Figure 1:
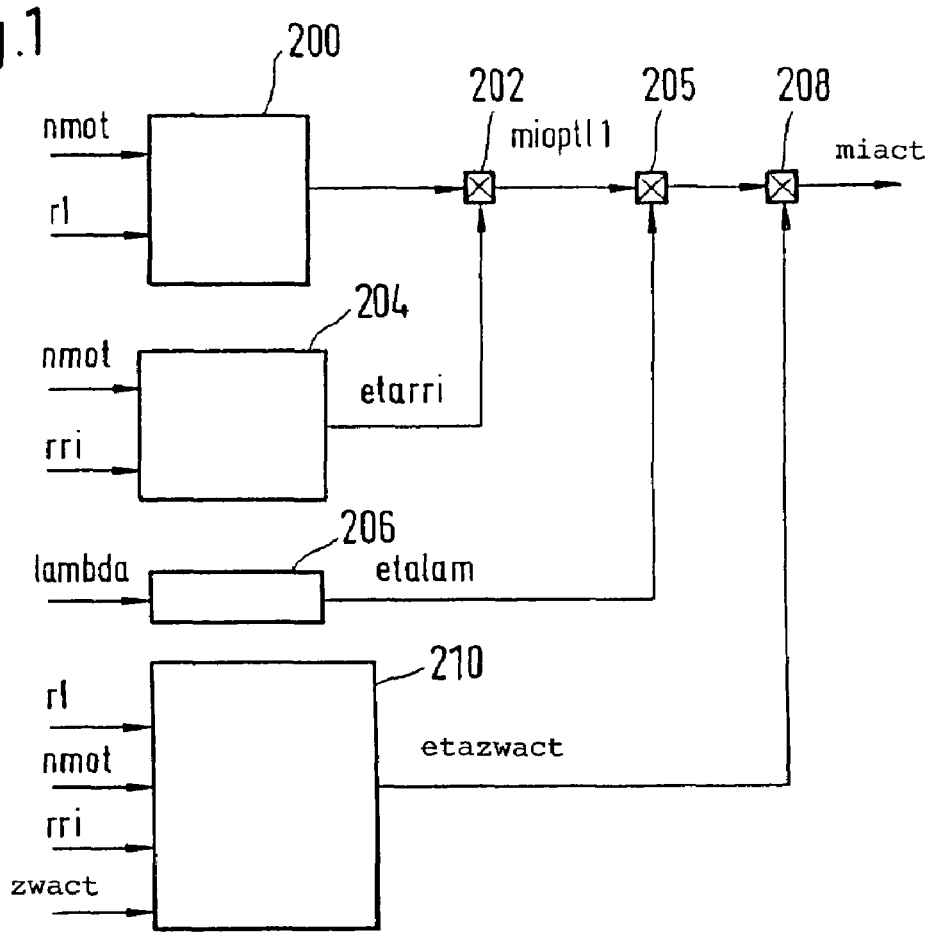
In FIGS. 1 to 4, sequence diagrams for a preferred embodiment of a torque model are shown with consideration of the combustion center.

In FIGS. 1 to 4, sequence diagrams are shown which show a preferred embodiment for optimization of the torque model for an internal combustion engine. The individual blocks define programs, program parts or program steps of a microcomputer of an electronic engine control unit whereas the arrows represent the flow of data.

This model is designed especially for systems having variable valve control wherein high inert gas rates, especially internal inert gas rates, can occur when there is significant valve overlap. What is essential in this torque model is the combustion center which is characterized as the crankshaft angle at which a specific quantity of the combustion energy is converted, preferably, half of the combustion energy. It has been shown that the position of the combustion center has a decisive influence on the conversion of the chemical combustion energy into indicated engine torque. Measurements show that there is a general relationship between the combustion center and the indicated torque which is essentially independent of engine rpm, engine load and residual gas content. Here, it has resulted that complete data as to the course of the torque characteristic are contained in a characteristic line of the combustion center as a function of the ignition angle. These characteristic lines can be described by a mathematical approximation function which contains only few parameters, for example, with a polynomial of the second order:

$$vbs=a*zw^2+b*zw+c$$

wherein: vbs is the combustion center of gravity [° KW], zw=ignition angle [° KW], and a, b, c are coefficients.

The coefficients of such a polynomial contain the characteristic information or data of the mixture, which is disposed in the combustion chamber, with reference to gas mass; composition; temperature; and, charge movement. If, as described above, the combustion center is introduced as an intermediate quantity, then two dependencies result for the ignition angle degree of efficiency: on the one hand, a fixed relationship to the combustion center for all loads, rpms and residual gas rates and, on the other hand, an operating-point dependent relationship of the combustion center in dependence upon the ignition angle. Accordingly, the relationship of the ignition angle degree of efficiency as a function of the ignition angle can be determined by introducing the combustion center as an intermediate quantity.

The model is used for the determination of control quantities from desired quantities as well as for the determination of actual quantities from measured operating variables. For this reason, the polynomial of the second order has been shown to be a suitable description of the relationship between combustion center and ignition angle because of its simple invertability. In other applications, polynomials of higher order or other mathematical functions are also applied for approximately describing the relationship when this has been shown to be suitable in the particular area, for example, increased precision, et cetera.

The sequence diagrams of FIGS. 1 to 4 show a realization example of how this recognition is realized with respect to the combustion center.

FIG. 1 shows the determination of the indicated actual torque miact. In a first characteristic field 200, the optimal torque value is formed in dependence upon the engine rpm nmot and the load r1. This optimal torque value is corrected in a correction position 202 by the efficiency etarri. This efficiency etarri is dependent on rpm and the residual gas rate and is determined in the characteristic field 204. The efficiency etarri describes the deviation with reference to the valve overlapment from the normal value. The efficiency value etarri is formed in characteristic field 204 in dependence upon signals which represent an inert gas rate via internal and external exhaust-gas recirculation.

A signal rri for the internal and external inert gas rate has been shown to be suitable and this signal is computed in dependence upon the position of the exhaust-gas recirculation valve and the inlet and outlet valve positions. The inert gas rate describes the component of the inert gas with respect to the total inducted gas mass. Another type of computation of the inert gas rate is based on the temperature of the recirculated exhaust-gas flow, lambda, the instantaneous air charge and the exhaust-gas pressure. The efficiency etarri is read out from the characteristic field 204 in dependence upon this signal rri and the engine rpm nmot. A signal wnw has been shown to be suitable for considering the charge movement and this signal represents the opening angle of the inlet valve (referred to the crankshaft or camshaft). In other embodiments, the position of a charge movement flap or a quantity is applied which represents the stroke and the phase of the opening of the inlet valves.

The optimal torque value corrected in this manner is then corrected (preferably, multiplied) in a further correction stage 205 by the lambda efficiency etalam which is determined in a characteristic line 206 in dependence upon the measured lambda value. The optimal torque value is then corrected (multiplied) in the correction stage 208 by the ignition angle efficiency etazwact, which is determined in a procedure 210 described hereinafter in dependence upon load r1, engine rpm nmot, inert gas rate rri and the adjusted ignition angle zwact. If, in lieu of the actual ignition angle, the basic ignition angle is used, then it is not the indicated actual torque miact which appears as the output of the correction stage 208 but, rather, as above, the base torque mibas.

Figure 3:
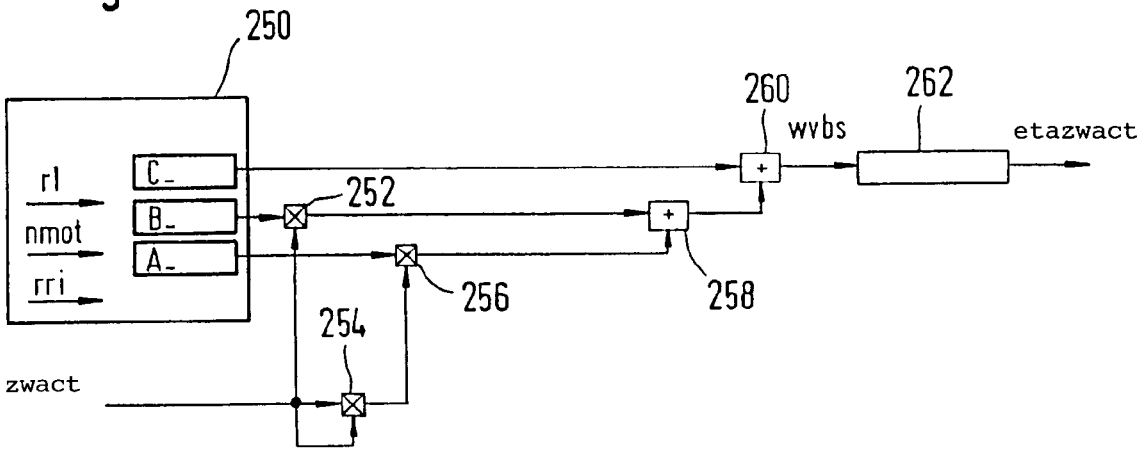

The determination of the ignition angle efficiency etazwact while considering the combustion center of gravity is shown in the sequence diagram of FIG. 3 by way of example. The example shown there shows an approximation via a polynomial of the second order. First, in 250, the factors A, B and C of the polynomial are determined in dependence upon operating quantities such as load, engine rpm and inert gas rate. This takes place in the context of pregiven characteristic fields. Thereupon, the adjusted actual ignition angle is multiplied by the parameter B in a multiplication stage 252. In a multiplication stage 254, the square of the actual ignition angle is formed which is then multiplied by the coefficient A in the multiplication stage 256. The results of the multiplication stages 252 and 256 are added in 258. The sum is added to the coefficient C in 260. The result is the angle of the combustion center of gravity which is converted into the ignition angle efficiency etazwact by means of a characteristic line 262. The characteristic line 262 is pregiven and defines the generally valid characteristic line of the ignition angle efficiency as a function of the angle of the combustion center of gravity.

Figure 2:
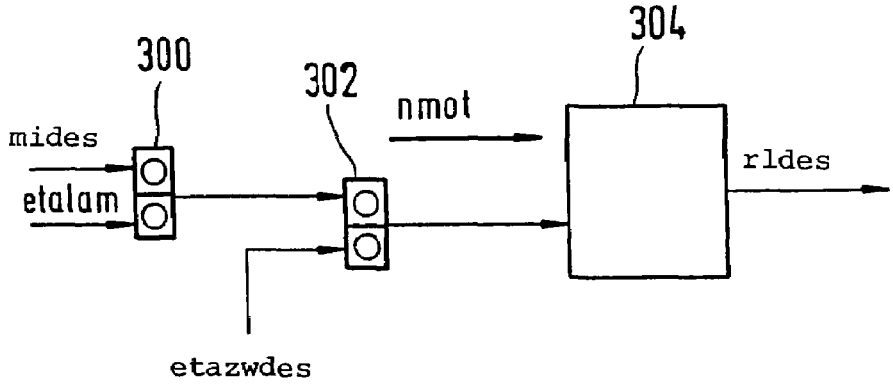

The shown torque model is not only suitable for determining actual quantities from operating quantities but, oppositely, is also suitable for determining actuating quantities from desired quantities. This procedure is shown by the sequence diagram of FIGS. 2 and 4. FIG. 2 shows a sequence diagram for determining the desired charge value which is converted into a desired value for the throttle flap position of the internal combustion engine while considering an intake manifold model. This desired value is adjusted in the context of a position control. The pregiven desired torque value mides is divided in the division stage 300 by the lambda efficiency etalam which is determined in correspondence to the procedure of FIG. 1. The desired torque value, which is corrected in this manner, is divided in a further division stage 302 by the efficiency of the desired ignition angle etazwdes. This desired ignition angle efficiency is pregiven, for example, as torque reserve in idle, as torque reserve for catalytic converter heating, et cetera. The desired torque, which is corrected in 302, is then converted into the charge desired value rides in accordance with the engine rpm nmot in a characteristic field 304. The charge desired value rides then functions for the adjustment of the air supply to the internal combustion engine.

Figure 4:
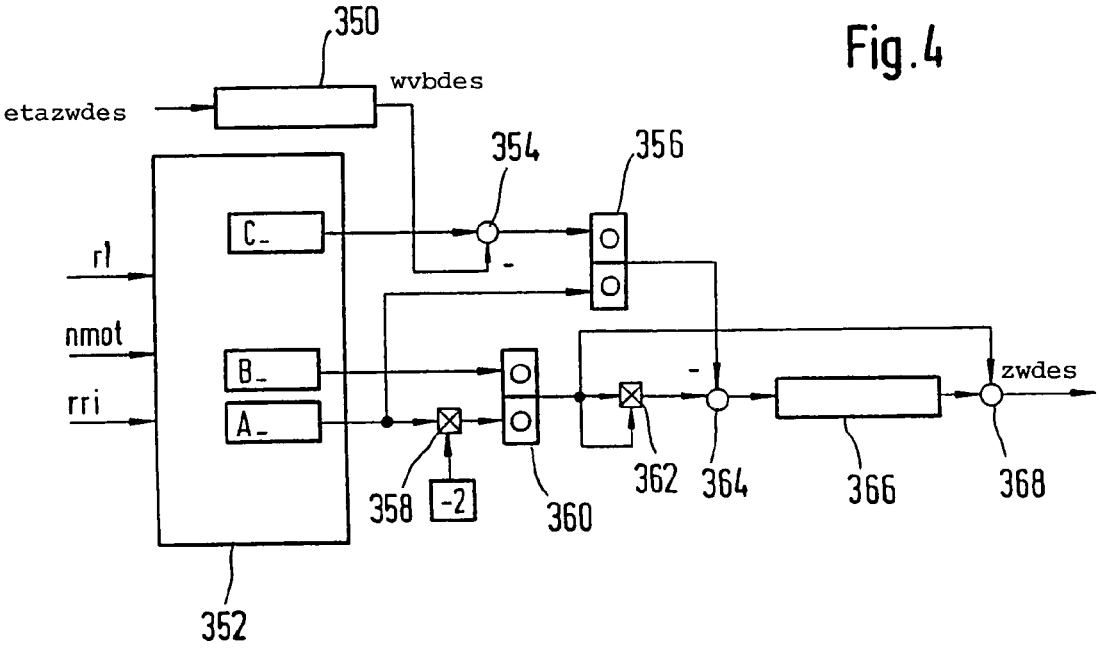

The determination of the desired ignition angle, which is to be set, is shown in FIG. 4. As intermediate quantity, the combustion center is again used. The approximation is derived by means of the polynomial known already from FIG. 3. The computation of the desired ignition angle is executed for given desired ignition angle efficiency, engine rpm and given fresh gas charge and residual gas charge. An inversion of the polynomial function is used. Furthermore, a characteristic line is used which defines the angle of the combustion center of gravity as a function of the ignition angle efficiency.

The pregiven ignition angle efficiency is therefore converted into a desired angle for the combustion center of gravity wvbdes in the characteristic line 350. In correspondence to the illustration in FIG. 3, the coefficients C, B and A of the polynomial function are determined in accordance with characteristic fields, characteristic lines or tables in 352 in dependence upon operating variables such as load, rpm and inert gas rate rri. The coefficient C is coupled to the desired value of the combustion center of gravity in the logic position 354. Preferably, the desired value of the combustion center of gravity is subtracted from the coefficient. In the division stage 356, the result of this logic coupling is then divided by the coefficient A. This coefficient A is then multiplied by the factor −2 in a multiplication stage 358. In the next division stage 360, the coefficient B is divided by the coefficient A multiplied by the value −2. The result is then squared in the multiplication stage 362 and is supplied to the logic position 364. There, the squared expression is logically coupled to the result of the division stage 356, especially, the last value is subtracted from the first. In 366, the square root is taken from the result and this is supplied to a further logic position 368. There, the square root is subtracted from the result of the logic position 360 and, in this way, the desired ignition angle zwdes, which is to be set, is formed.

In the determination of the coefficients A to C, also additional operating quantities are used in addition to the above-mentioned operating quantities. These additional operating quantities are, especially, the valve overlapment angles or the opening angles of the inlet valves or the position of a charge movement flap or stroke and phase of the inlet valve.

The characteristic fields and characteristic lines, which are used to compute the model, are determined in the context of the application for each engine type, if required, while utilizing the above-mentioned software tool.

Figure 5:
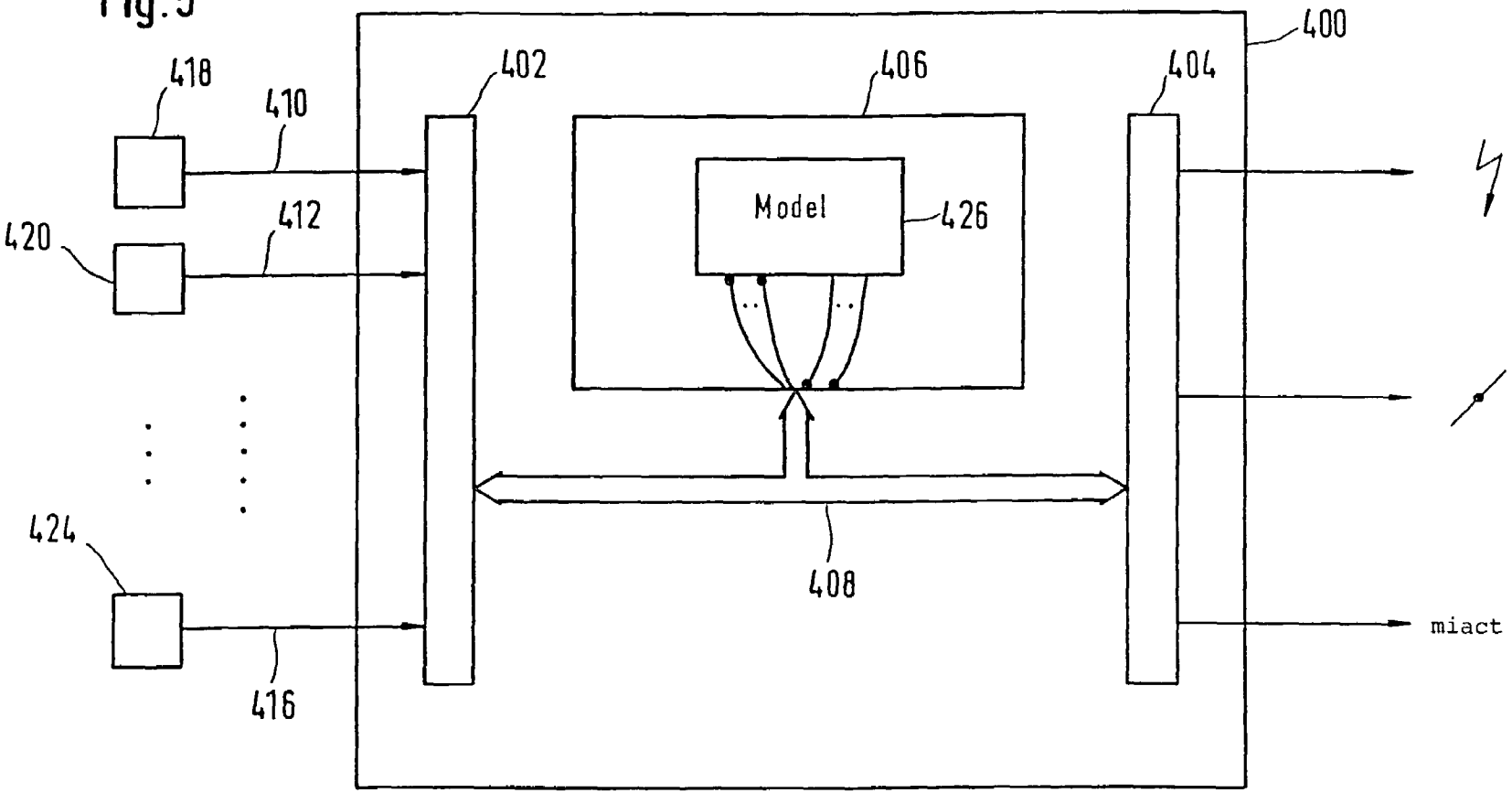
FIG. 5 shows an overview diagram of an engine control wherein the sketched model is applied.

FIG. 5 shows a control unit 400 which includes an input circuit 402, an output circuit 404 and a microcomputer 406. These components are connected to a bus system 408. The operating quantities, which are to be evaluated for engine control, are supplied via input lines 410 and 412 to 416. These operating quantities are detected by measuring devices 418 and 420 to 424. The operating quantities which are needed for model enrichment are illustrated above. The detected and, if required, prepared operating quantity signals are then read in by the microcomputer via the bus system 408. In the microcomputer 406 itself, the commands are there stored in its memory as a computer program which is used for model computation. This is symbolized in FIG. 5 by 426. The modeling results, which are processed, if needed, in still other programs (not shown) are then supplied from the microcomputer via the bus system 408 to the output circuit 404 which then outputs drive signals as actuating quantities, for example, for adjusting the ignition angle and the air supply as well as measurement quantities such as, for example, the actual torque miact.

What is claimed is:

1. A method for controlling an internal combustion engine, the method comprising the steps of:

performing at least one of the steps of:

(a) computing at least one actual quantity;

(b) deriving at least one actuating quantity from an input quantity; and, utilizing a relationship in the above computation and/or derivation which defines a dependency of the combustion center on the ignition angle with said combustion center corresponding to the crankshaft angle at which a pregiven component of the combustion energy is converted.

2. The method of claim 1, comprising the further step of determining the actual quantity in accordance with a relationship between the ignition angle efficiency and the combustion center.

3. The method of claim 1, comprising the further step of determining the combustion center in accordance with a pregiven function in dependence upon the ignition angle and operating quantities such as load, engine rpm and inert gas rate.

4. The method of claim 1, comprising the further step of determining the actuating quantity in dependence upon a desired combustion center, which is determined from the desired ignition angle efficiency, and operating quantities such as load, rpm and inert gas rate.

5. The method of claim 1, comprising the further step of utilizing a polynomial of the second order to determine the combustion center, the polynomial describing the dependency of the combustion center on the ignition angle.

6. The method of claim 1, comprising the further step of using a polynomial of higher order or another suitable mathematical relationship to determine the combustion center, the polynomial describing the dependency of the combustion center on the ignition angle.

7. An arrangement for controlling an internal combustion engine, the arrangement comprising:

a control unit wherein a torque model is stored with the aid of which at least one actual quantity of the internal combustion engine is determined and/or at least one actuating quantity is determined in dependence upon a pregiven value; and, means for determining the actual quantity and/or the actuating quantity in the context of the torque model while considering a relationship which describes the dependency of the combustion center on the ignition angle, the combustion center corresponding to the crankshaft angle of the internal combustion engine at which a pregiven component of the combustion energy is converted.

8. A computer program comprising program code means for carrying out a method for controlling an internal combustion engine when the program is executed on a computer, the method including the steps of:

performing at least one of the steps of:

(a) computing at least one actual quantity;

(b) deriving at least one actuating quantity from an input quantity; and, utilizing a relationship in the above computation and/or derivation which defines a dependency of the combustion center on the ignition angle with said combustion center corresponding to the crankshaft angle at which a pregiven component of the combustion energy is converted.

9. A computer program product comprising program code means, which are stored on a computer-readable data carrier in order to carry out a method for controlling an internal combustion engine when the program product is executed on a computer, the method including the steps of:

performing at least one of the steps of:

(a) computing at least one actual quantity;

(b) deriving at least one actuating quantity from an input quantity; and, utilizing a relationship in the above computation and/or derivation which defines a dependency of the combustion center on the ignition angle with said combustion center corresponding to the crankshaft angle at which a pregiven component of the combustion energy is converted.

* * * * *